US005385526A

United States Patent [19]

Sigrist et al.

[11] Patent Number: 5,385,526

[45] Date of Patent: Jan. 31, 1995

[54] APPARATUS AND METHOD FOR PACKAGING BLANKS

[75] Inventors: Albert Sigrist, Colombier; Roberto Rizzolo, Champ-du-Moulin, both of Switzerland

[73] Assignee: Fabriques de Tabac Reunies, SA, Qual Heanrenaud, Switzerland

[21] Appl. No.: 200,856

[22] Filed: Feb. 22, 1994

Related U.S. Application Data

[63] Continuation of Ser. No. 881,787, May 12, 1992, abandoned.

[30] Foreign Application Priority Data

May 16, 1991 [CH] Switzerland ..... 1468/91

[51] Int. Cl.[6] ..... B31B 1/00; B65H 45/30

[52] U.S. Cl. ..... 493/14; 493/17; 493/55; 493/123; 493/130; 493/126; 493/144; 493/147; 493/151; 493/178; 493/416; 493/417; 493/438

[58] Field of Search ..... 493/13, 14, 17–20, 493/27, 55, 123, 125, 130, 144, 147, 151, 178, 416, 417, 436, 438, 455, 126, 128, 129, 131; 156/202, 204, 227

[56] References Cited

U.S. PATENT DOCUMENTS

| | | | |
|---|---|---|---|
| 2,894,434 | 7/1959 | Belton et al. | 93/49 |
| 2,936,681 | 5/1960 | Earp | 271/11 |
| 3,029,021 | 4/1962 | Azari | 271/5 |
| 3,252,700 | 5/1966 | Henry | 493/19 |
| 3,381,593 | 5/1968 | Gentry | 493/416 |
| 3,433,135 | 3/1969 | Lokey | 493/14 |
| 4,369,962 | 1/1983 | Spiro | 271/11 |
| 4,998,910 | 3/1991 | Mohaupt | 493/12 |
| 5,029,834 | 7/1991 | Boldrini | 271/11 |
| 5,108,085 | 4/1992 | Smith | 271/276 |
| 5,120,292 | 6/1992 | Ueda | 493/124 |

FOREIGN PATENT DOCUMENTS

| | | |
|---|---|---|
| 2338136 | 8/1977 | France . |
| 3930720 | 5/1990 | Germany . |
| 1253430 | 10/1989 | Japan . |
| 326980 | 2/1958 | Switzerland . |
| 2098538 | 11/1982 | United Kingdom . |
| WO9010535 | 9/1990 | WIPO . |

*Primary Examiner*—Jack W. Lavinder

*Attorney, Agent, or Firm*—Kevin B. Osborne; James E. Schardt; Charles E. B. Glenn

[57] ABSTRACT

The blanks (1) are withdrawn one after another from a storage part (20) by transfer means (21) and are disposed on the cylindrical support surface of a drum (3) driven rotatingly by portions of a revolution. Various processing operations are performed on the blanks either while the drum is rotating or while it is stopped, e.g., folding a flap (16), gluing this flap to a surface portion (15) of the blank, or printing a code (17) on part of the blank. The presence, correct positioning, and proper alignment of the blank on the drum are checked before the aforementioned operations are carried out. After they have been effected, the blank is withdrawn from the drum to be sent on to a packaging machine. The processing apparatus and method can be utilized on a line for processing boxes or the like, particularly cigarette boxes, just before they are assembled to receive their contents. They permit a higher rate of production than prior art apparatus and methods, take up less space, and ensure reliable operation owing to a high degree of integration and automation.

83 Claims, 10 Drawing Sheets

APPARATUS AND METHOD FOR PACKAGING BLANKS

Figure 1A:
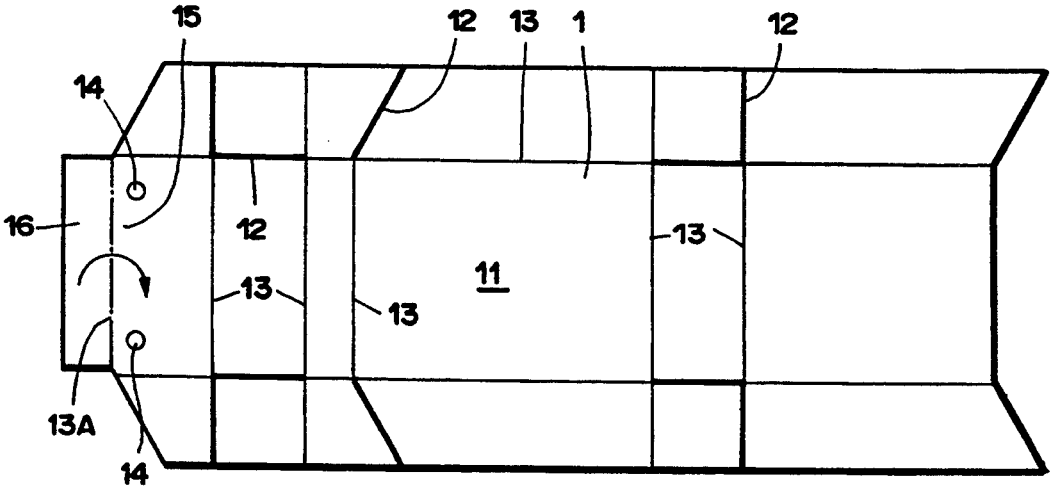

This is a continuation of copending application(s) Ser. No. 07/881,787 filed on May 12, 1992 now abandoned.

This invention relates to packaging equipment, and more particularly to apparatus for processing cardboard packaging blanks, especially for cigarette boxes. The invention further relates to a method of processing such blanks.

The packaging of batches of articles, especially packs of cigarettes, requires a large number of operations. The present invention concerns particularly the processing of a cardboard blank for a box after it has received any sort of imprint, for publicity or otherwise, on one of its faces, has been cut, and has been scored as necessary for folding into a box. The operations to which the present invention relates consist in depositing one or more drops of adhesive on one or more surface portions of the blank, folding and turning down one or more surface portions or flaps, adjacent to the preceding surface portions, over these preceding surface portions, and pressing the turned-down surface portions tightly against one another in order to constitute one or more new reinforced surface portions, then impressing a code on some surface portion of the blank. Thereafter, the blank is conveyed to a packaging machine, where the box will finally be formed around the pack of cigarettes; this operation, however, no longer forms part of the present invention.

In the prior art, a machine carrying out the aforementioned operations is usually disposed just before or at the intake of a packaging machine. Such a processing machine is generally made up of a first part, where the blanks are stored and from which they are successively withdrawn and disposed consecutively on a conveyor belt, from which they are withdrawn opposite each work station where they undergo one or another of the operations mentioned above. Owing to the numerous movements of the blanks from the conveyor belt to each work station and back, it is difficult to work at high speed with such apparatus, where a processing rate of 400 blanks/min. can usually not be exceeded. Moreover, since each processing operation is carried out following the preceding one, on a downstream portion of the conveyor belt, prior art processing machines are quite large.

It is an object of this invention to provide an improved method and apparatus for processing cardboard packaging blanks, particularly blanks of cigarette boxes, which are capable of working at a high speed of production, viz., at a rate well above 400 blanks/min.

A further object of this invention is provide such apparatus which is much less bulky than prior art processing machines, with simplified synchronization of the various operations to be carried out.

Another object of this invention is to provide apparatus by means of which the presence or absence of a blank can be checked, as well as its correct positioning, in order to control the running of the packaging machine and thus reduce production losses due to pile-ups and stoppages of the machine.

To this end, in the apparatus according to the present invention, the improvement comprises a drum rotating about its longitudinal axis, having a circular cylindrical support surface, as well as means for holding the blanks on this cylindrical support surface; transfer means withdrawing the blanks one by one from a storage part in order to dispose them one after another on the cylindrical support surface of the drum; means for processing the blanks, and including at least one of the following means: checking means for verifying the correct presence, orientation, and alignment of a blank on a portion of the cylindrical support surface of the drum, means for depositing at least one drop of adhesive on at least one surface portion of the blank, means for folding at least one surface portion of the blank about at least one preformed fold, means for compressing at least one other surface portion bent over at least one surface portion on which at least one drop of adhesive has been deposited, means for impressing a code or a text on at least one further surface portion of the blank; as well as withdrawing means withdrawing the blanks one by one from the cylindrical support surface of the drum in order to dispose them on routing means for conveying them to the following machine, and control means for synchronizing the operation of the apparatus.

In the method of processing a packaging blank according to the present invention, the blank is withdrawn from a package by transfer means, the blank is deposited on a longitudinal portion of the cylindrical support surface of a drum, where it is held in place by holding means, after the transfer means have ceased their action, the drum being actuated with a sequential rotary movement, and at least one of the following processing steps is carried out: checking of the correct presence, positioning, as well as orientation of the blank by checking means, deposit of at least one drop of adhesive on at least one surface portion of the blank, introduction of at least one other surface portion of the blank into folding means where at least one fold is formed, introduction of the other surface portion or portions into compression means where they are pressed against the surface portion or portions which have received adhesive, impression of a code on at least one further surface portion of the blank, following which the blank is withdrawn from the drum by withdrawing means after the holding means have ceased their action.

The inventive apparatus and method have been developed, and will be described below, as applying to cardboard blanks for packs of cigarettes. However, it should be understood that everything described below may equally well apply to packaging made of cardboard or having a certain rigidity and intended for any use other than cigarette boxes.

Figure 1B:
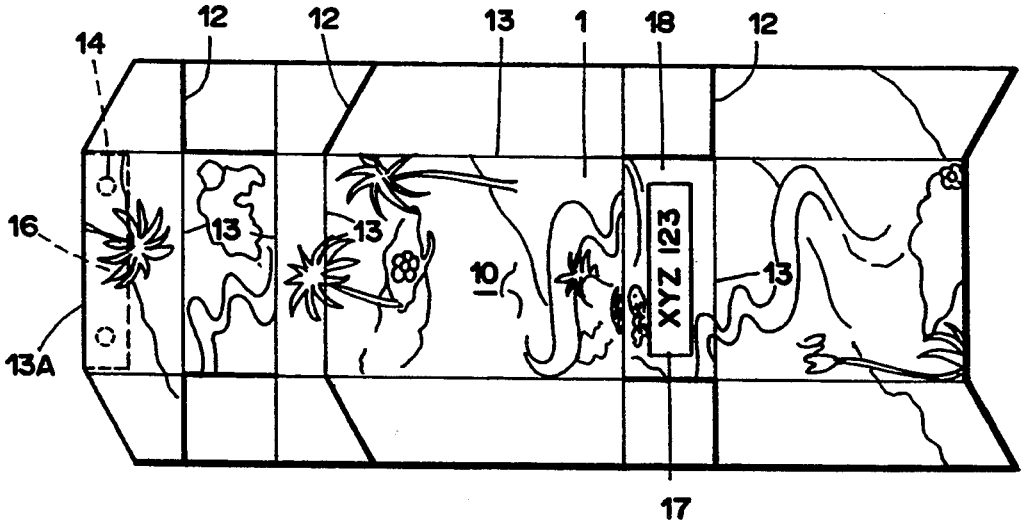
Figure 2A:
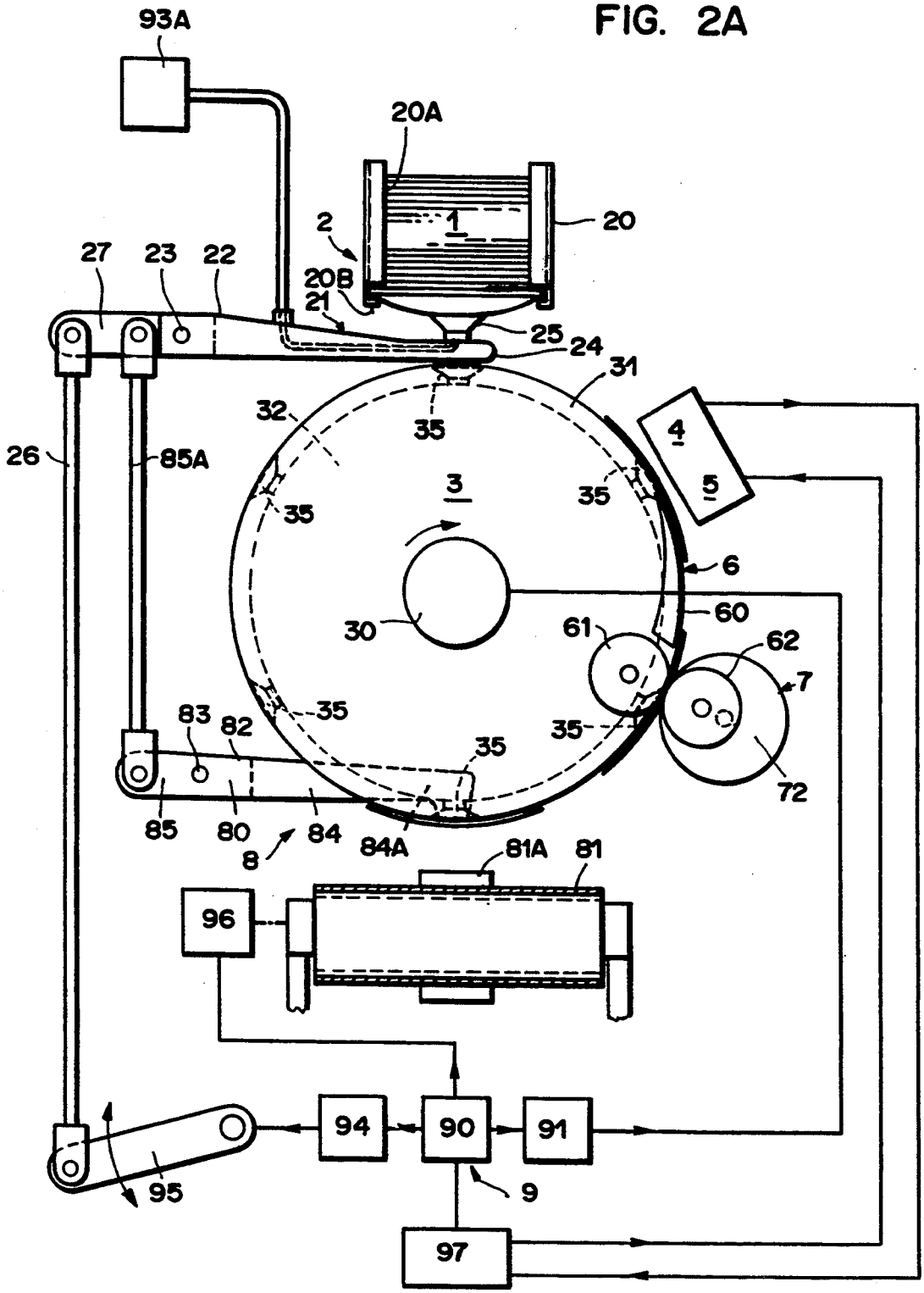
Figure 2B:
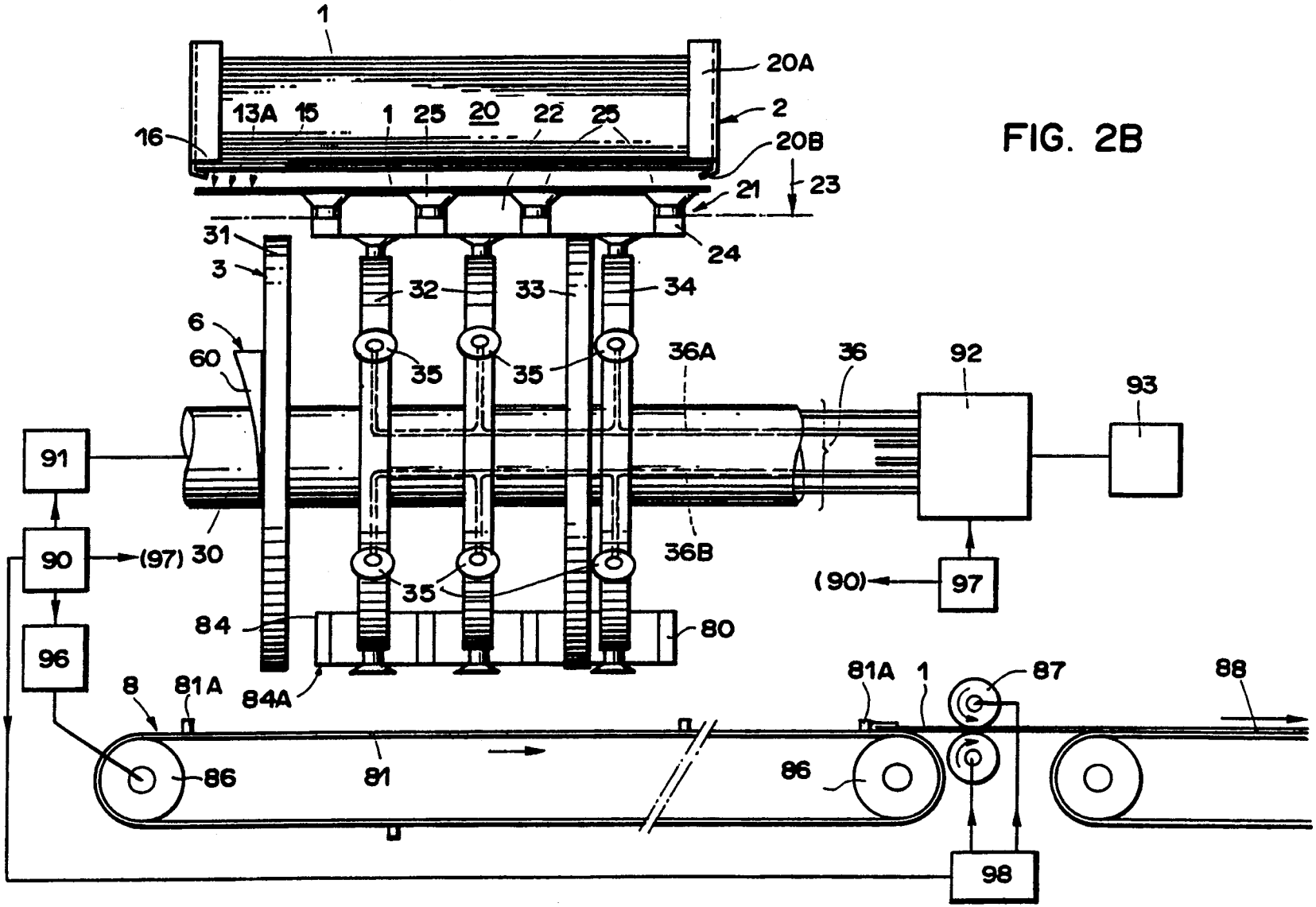
Figure 2C:
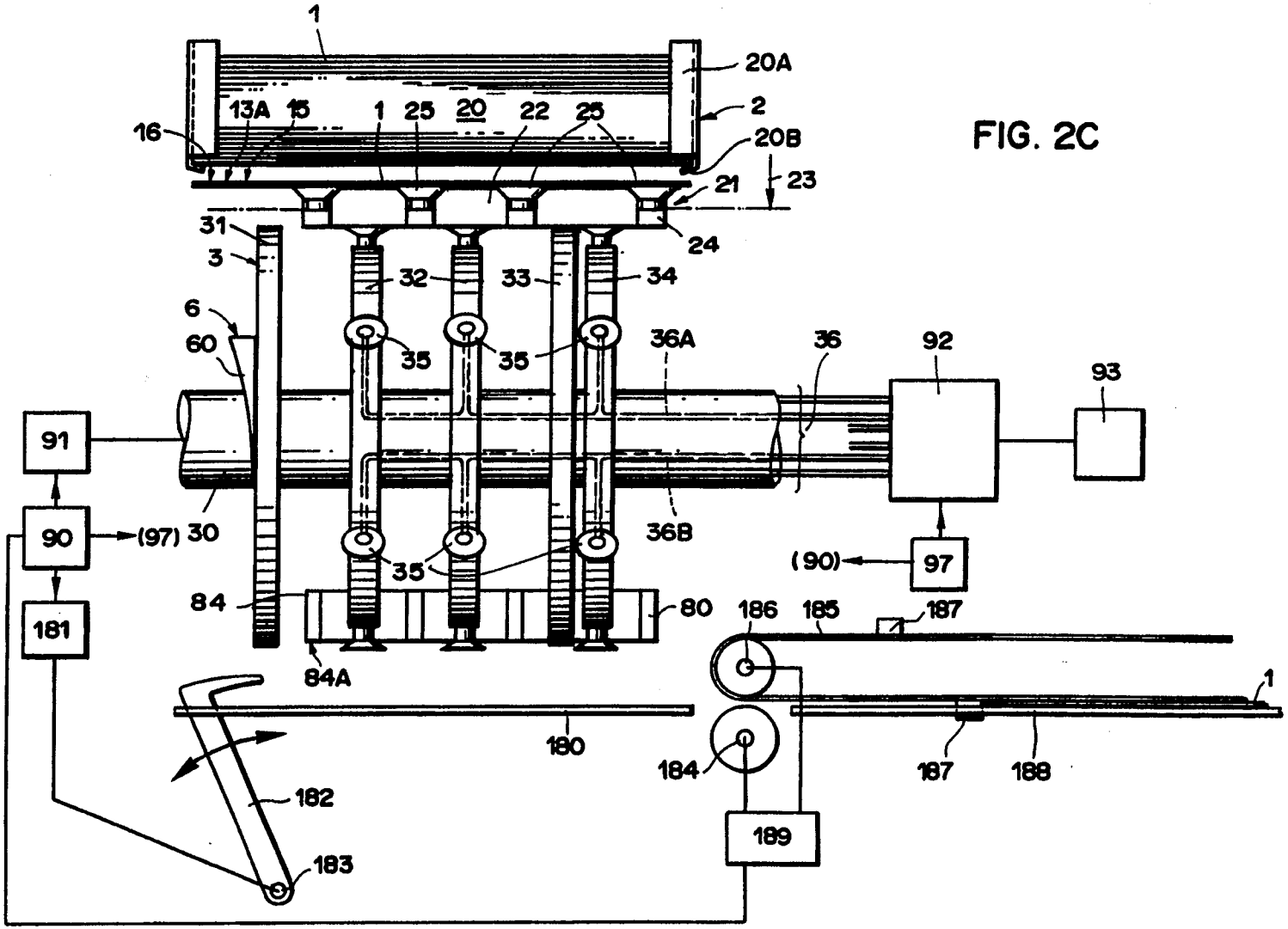
Figure 3:
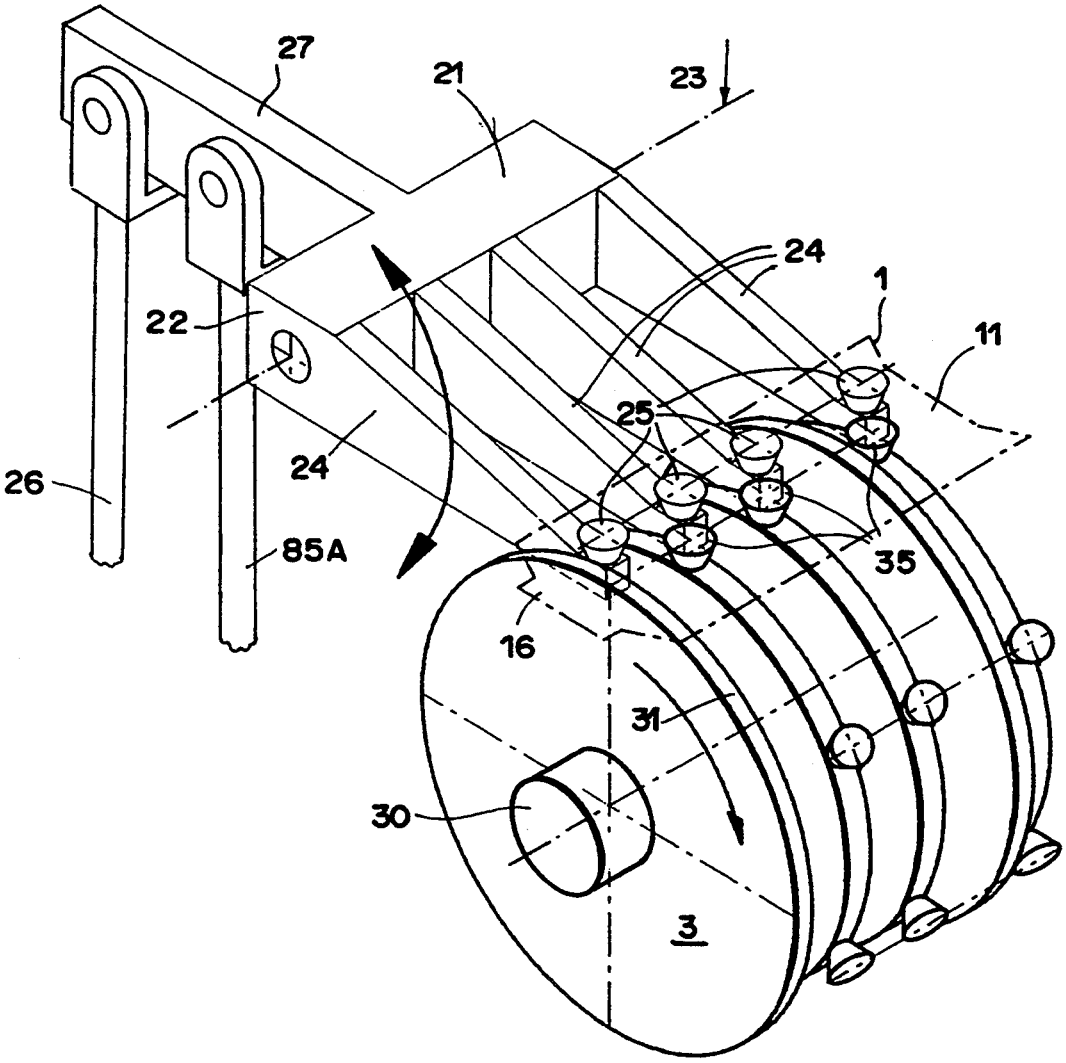
Figure 4A:
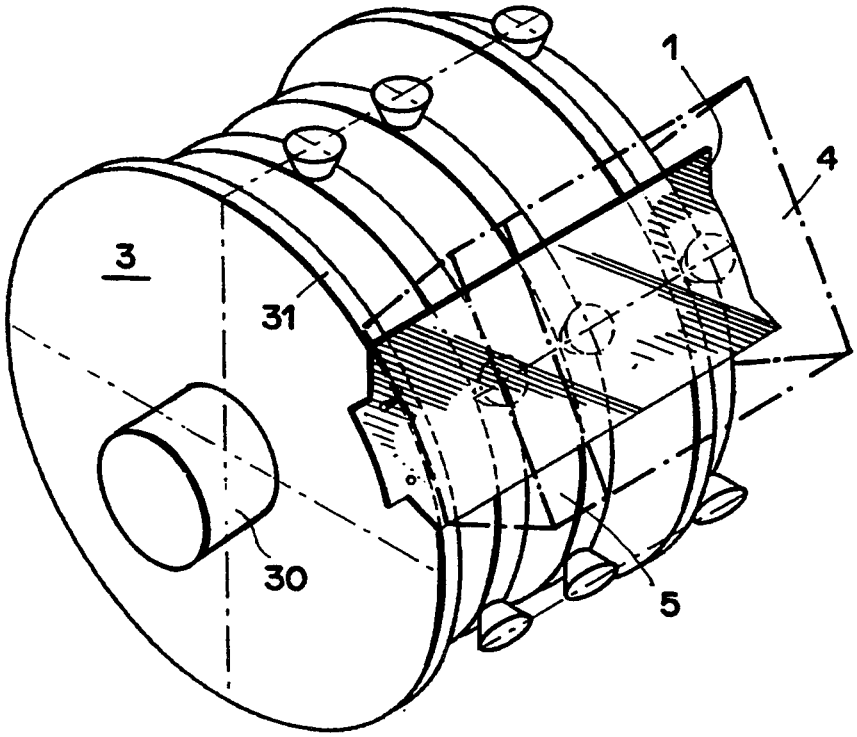
Figure 4B:
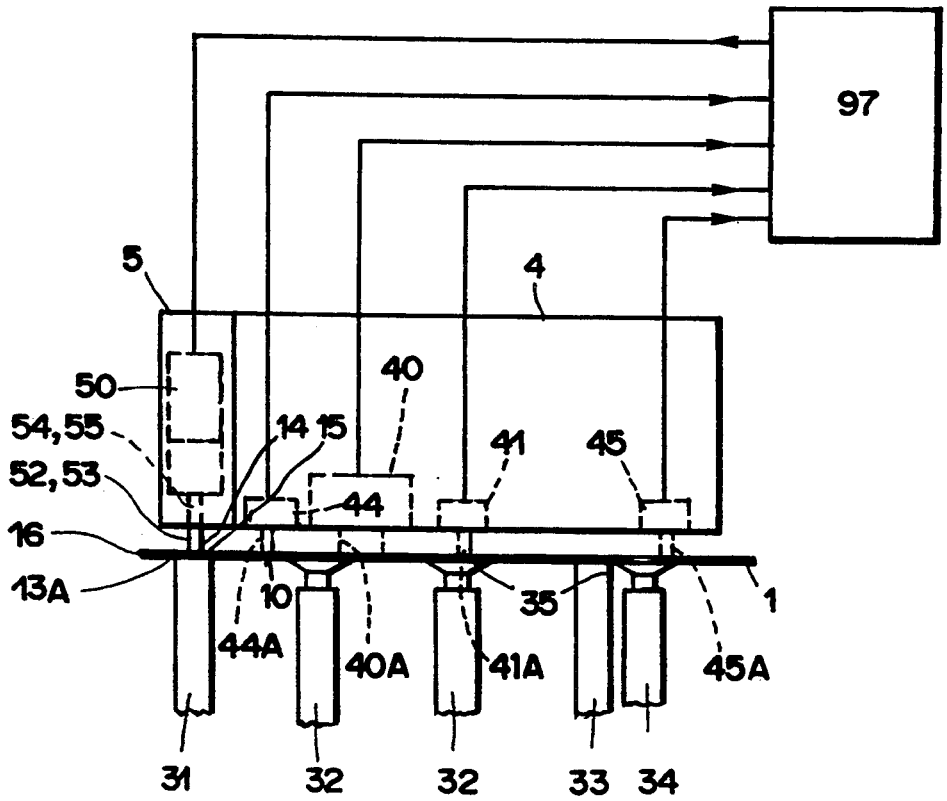
Figure 4C:
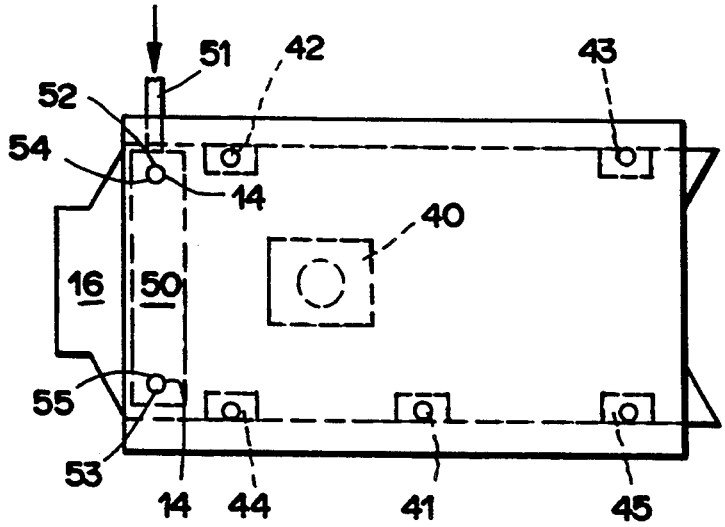
Figure 5:
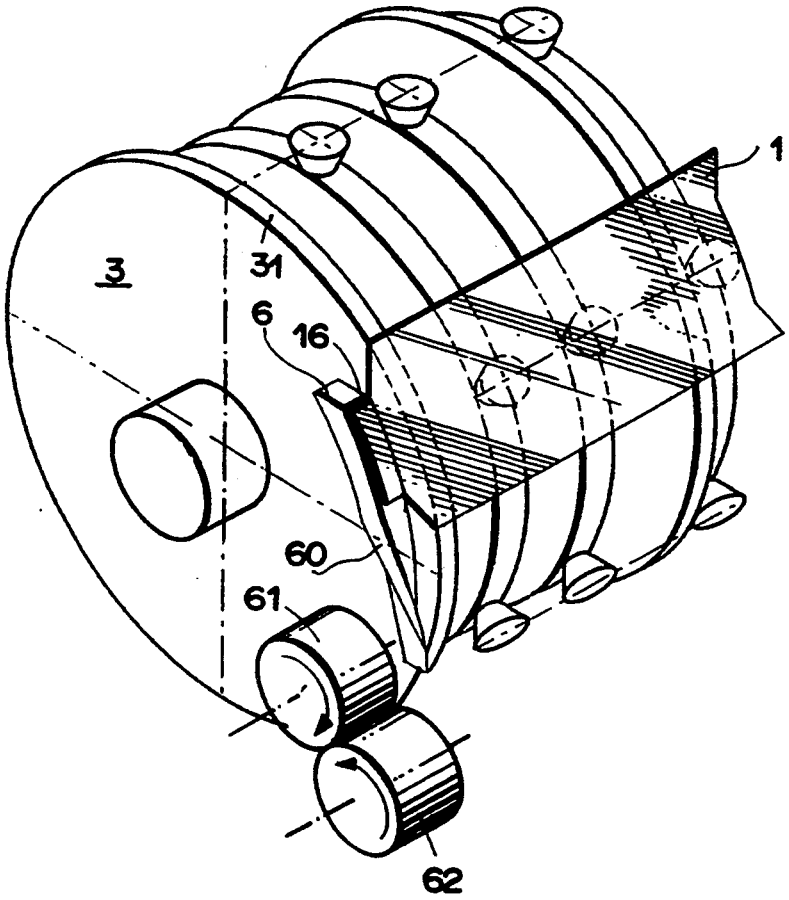
Figure 6A:
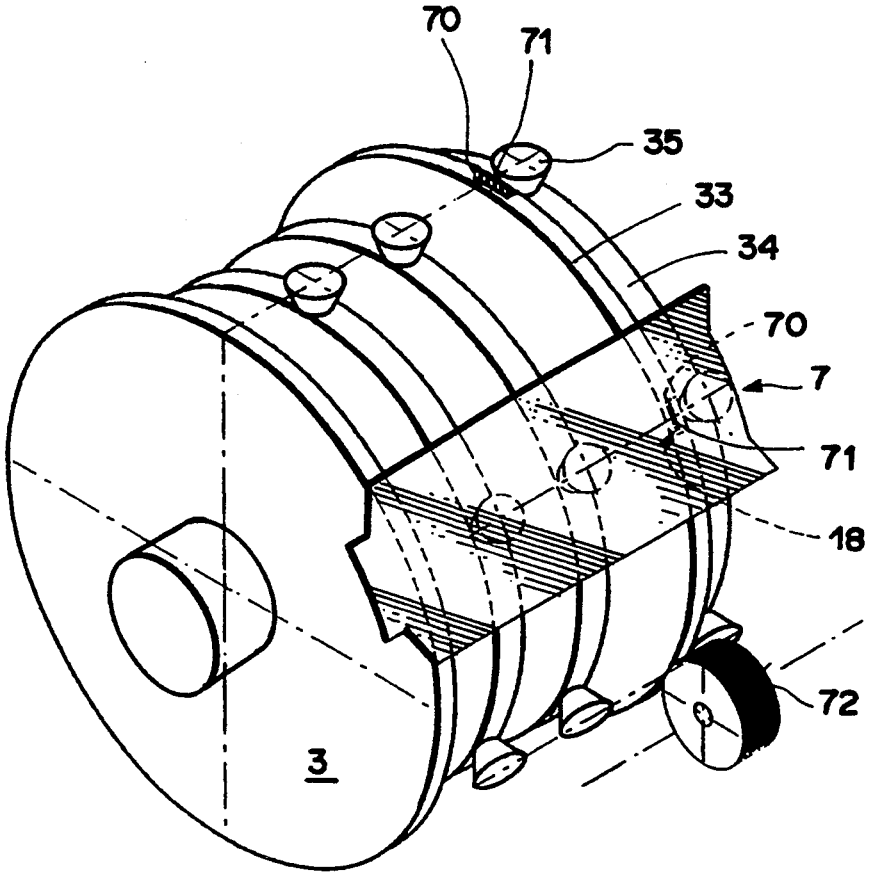
Figure 6B:
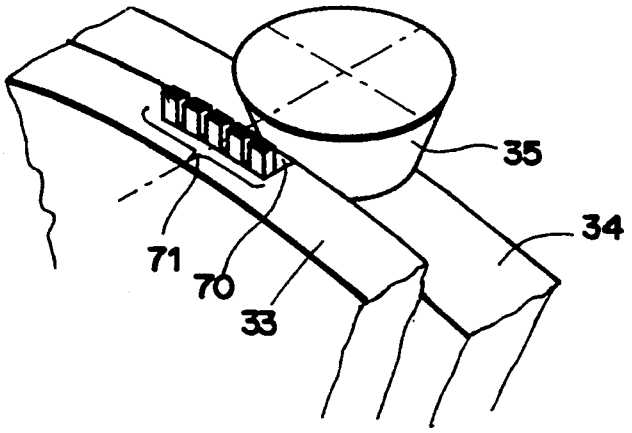
Figure 7:
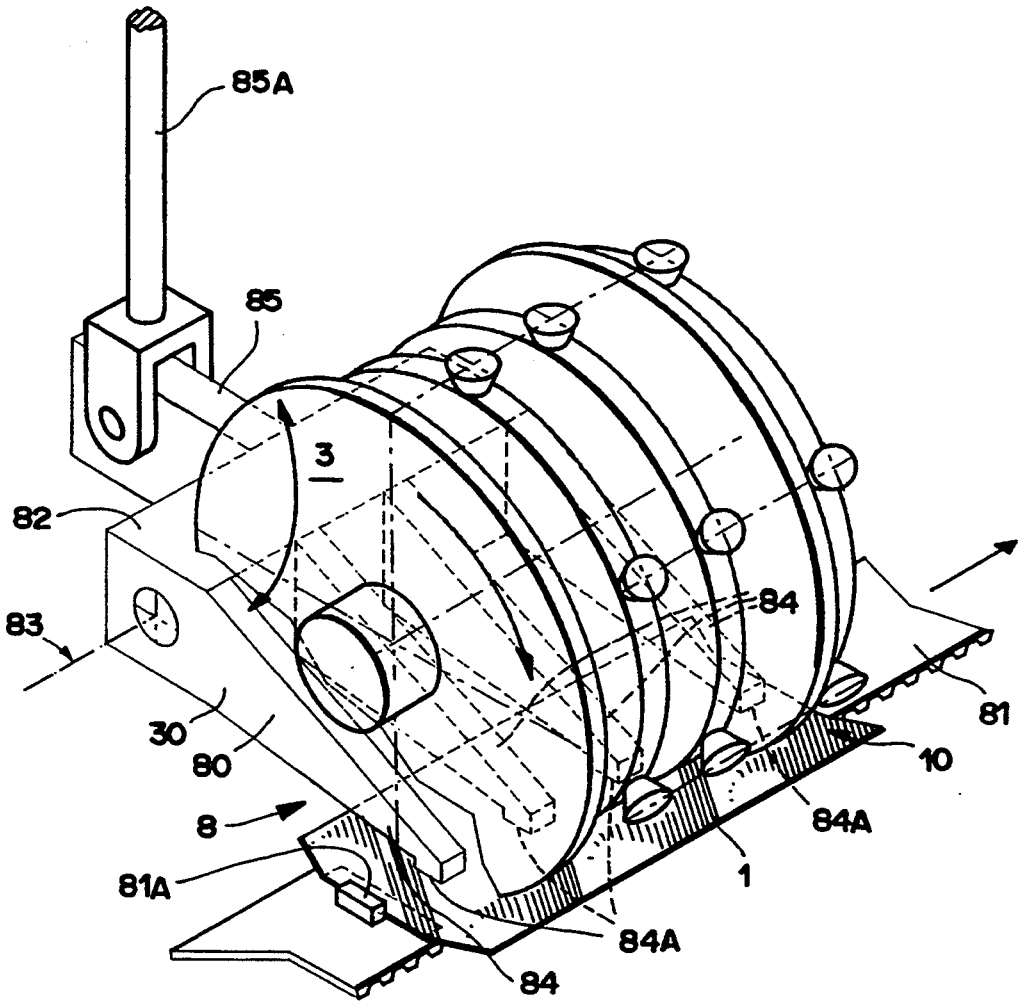

A preferred embodiment of the invention will now be described in detail with reference the accompanying drawings, in which:

FIGS. 1A and 1B are top plan views of the back and front, respectively, of a blank for a cigarette box, with one surface portion, or flap, being shown bent back in FIG. 1B, FIGS. 2A and 2B are end and side elevations, respectively, of part of the processing apparatus, FIG. 2C is a side elevation of part of the processing apparatus comprising a modification of the routing means, FIG. 3 is a perspective view of the transfer means of the apparatus FIGS. 4A–4C are a perspective view, a diagram, and a top plan view, respectively, of the checking and gumming means of the apparatus, a preferred arrangement of photoelectric cells being shown in FIG. 4C, FIG. 5 is a perspective view of the folding means of the apparatus, FIGS. 6A and 6B are perspective views of the impression means of the apparatus, FIG. 6B being on a larger scale, and FIG. 7 is a perspective view of a design of the withdrawing means of the apparatus.

FIGS. 1A and 1B illustrate a specimen of a cardboard blank 1 intended to form the box for a pack of cigarettes, as readied for introduction into the processing apparatus according to the present invention. A face 10 of blank 1, the front of the blank, was first imprinted with some design or text, whereas the back 11 was left unprinted. Blank 1 was then cut to the desired shape, the blanking operation also including a number of cuts 12 clipped into the contour, shown as heavier lines, intended to facilitate the subsequent fashioning of the box. Simultaneously, a number of scoring lines 13, shown as lighter lines, were also made on the blank, corresponding to the subsequent folds of the box. The blanks prepared in this way, or in some other comparable manner, are supplied to the distribution means of the apparatus in the form of stacks, with all the superimposed blanks turned and oriented identically.

The operations to be carried out by the processing apparatus are:

seizing a blank from a supply stack, placing one or more spots of adhesive 14 on a surface portion 15 of the back 11 of blank 1, folding a surface portion 16, or flap, adjacent to surface portion 15, about a score 13A, laying surface portion 16 against surface portion 15 and gluing the two surfaces together in order to reinforce a portion of the box which will later serve as a gripping point for opening the pack of cigarettes, impressing a code 17 on a surface portion 18 of the front 10 of blank 1, and sending blank 1 thus processed to the packaging machine.

The operations described above obviously relate to the chosen example of processing a specific blank for a pack of cigarettes. However, other bending operations, with or without gluing, as well as other printing operations, may equally well be envisaged. By the same token, one or another of the mentioned operations may be omitted. The processing apparatus described below may therefore be adapted as a function of the operations to be carried out.

FIGS. 2A and 2B are partial elevations of the processing apparatus in a preferred embodiment of the invention, the apparatus being viewed from the end in FIG. 2A and from the side in FIG. 2B. The main elements making up the inventive apparatus are to be seen, particularly in FIG. 2A: distribution means 2, comprising storage means 20 and transfer means 21; a drum 3 about which checking means 4 and adhesive-depositing means 5 are disposed, jointly symbolized by a block 4/5; bending means 6, impression means 7, and blank-withdrawing means 8 including a withdrawal device 80 and means 81 for routing to the packaging machine, as well as driving, suction, and control means 9.

The main element of the inventive apparatus is drum 3, a preferred design of which is illustrated in FIG. 2B. It is made up of a longitudinal shaft 30 supported by two bearings of the machine (not shown) and driven in sequential rotation, e.g., by a motor 90, preferably an electric motor, on the shaft of which a conventional gearbox 91 is mounted, the output shaft of which has a movement of discontinuous rotation composed of portions of revolutions, between which the output shaft is stopped. Gearbox 91 is indexed in such a way that its output shaft effects portions of a revolution equal, in the present embodiment, to one-sixth of a revolution, between which longitudinal shaft 30, and thus drum 3, are stationary.

Shaft 30 bears a plurality of disks 31, 32, 33, and 34 disposed coaxially and in planes transverse to the longitudinal axis of shaft 30 and spaced from one another. Disk 31 is a support disk, while disks 32 and 34 are holding disks, and disk 33 has a dual function, being both a support disk and an impressing disk, as will be seen below. Support disks 31 and 33 have the same relatively large outside diameter, the outside cylindrical surfaces of these two disks defining the cylindrical support surface of drum 3 upon which the blanks are to be disposed. These blanks have been omitted from FIG. 2B in order not to clutter the drawing.

In the space separating support disks 31 and 33 are the two holding disks 32, while the third holding disk 34 is disposed outside that space, near disk 33. The outside diameter of holding disks 32, 34 is less than that of support disks 31 and 33. Suction nozzles 35, six for each of the holding disks 32, 34 in the embodiment illustrated, are disposed along the peripheries of these holding disks, spaced at regular intervals, e.g., every 60° in this example (see FIG. 2A). The diameter of holding disks 32 and 34 and the height of suction nozzles 35 are such that the suction surfaces of these nozzles are tangent to the cylindrical support surface of drum 3 defined by the support surfaces of support disks 31 and 33, as stated above. The suction nozzles 35 of each of the holding disks 32, 34 are mutually aligned on generatrices of the mentioned cylindrical support surface.

Shaft 30 is preferably hollow, its central cavity being occupied by a plurality of suction ducts 36, six in the embodiment illustrated; only two of these ducts, 36A and 36B, are shown in their entirety in FIG. 2B in order not to clutter the drawing. It will be noted that duct 36A is connected to three suction nozzles 35 disposed on a single generatrix, whereas the other duct 36B is connected to the three nozzles 35 disposed on another single generatrix. In other words, each of the nozzles 35 disposed on the same generatrix is connected to the same independent suction duct. The other ends of ducts 36 are connected to a conventional distributor 92 for controlling the suction of the nozzles 35 disposed on a given generatrix as a function of the operating steps of the blank-processing apparatus, as will be seen below. Distributor 92 is connected to a conventional suction installation 93. In this way, suction may be selectively controlled for each row of nozzles 35, so that a blank 1 can be held by the vacuum created by three nozzles 35 aligned on a generatrix of the cylindrical support surface of drum 3.

Storage means 20 of distribution means 2 may be seen in FIGS. 2A and 2B, disposed exactly above drum 3, perpendicular to the longitudinal axis of shaft 30. They are preferably composed of four angle-irons 20A disposed vertically at the four corners of the stored stack of blanks 1, the stack being held at the bottom by portions of inclined walls 20B, so that the stack is held in storage means 20, but the blank disposed under the stack can be extracted from it by withdrawal from the bottom of the stack. All the blanks 1 are disposed in the stack with their front or printed faces 10 downward and the surface portion 16 to be bent at the left of the stack, as viewed in FIG. 2B, so that score 13A is situated slightly out of plumb with the outer circular face of cylinder 3, i.e., with support disk 31.

Transfer means 21 of distribution means 2 may be seen in FIGS. 2A, 2B, and 3A. These transfer means comprise firstly a middle part 22 pivoting about an axis 23 parallel to the axis of shaft 30 at the back of the processing apparatus and approximately between storage means 20 and drum 3. Extending from the side of part 22 nearest drum 3 are a plurality of seizing fingers 24, four in the example illustrated, projecting perpendicular to axis 23 and capable of entering the space occupied by drum 3 between disks 31, 32, or 33. As is seen in FIG. 2B, a first seizing finger 24 can pass between support disk 31 and the first holding disk 32, a second between the two holding disks 32 in the center, and a third between the second holding disk 32 and the second support disk 33, while a fourth passes outside the last holding disk 34, which is close to support disk 33. Any other respective arrangement of the disks and fingers may also be envisaged, according to the operations to be carried out. Each of the seizing fingers 24 is provided at the end thereof with a suction nozzle 25 similar to the suction nozzles 35 and facing upward. A single flexible conduit connects suction nozzles 25 to a conventional sequential suction installation 93A (see FIG. 2A), which may be the same as suction installation 93 mentioned earlier.

The oscillating movement of seizing fingers 24 about axis 23 is produced, as may be seen in FIG. 2A, by the overall driving motor 90 of the apparatus to which there is connected a conventional gearbox 94 converting the continuous rotational movement of the output shaft of motor 90, i.e., the primary shaft of gearbox 94, into a movement of angular oscillation of the output shaft of that gearbox. A crank-pin 95 mounted on the output shaft of box 94 transmits this oscillatory motion to a rod 26 connected to a lever arm 27 projecting from middle part 22 of transfer means 21 in the opposite direction from seizing fingers 24. Crank-pin 95 is connected to rod 26, and rod 26 to lever arm 27, by conventional pivot couplings. Thus, the rotary movement of motor 90 is converted into an oscillatory motion of crankpin 95, which motion is transmitted to seizing fingers 24 via rod 26 and lever arm 27. Hence the oscillating movement of seizing fingers 24 is absolutely synchronized with the rotary movement of motor 90 and is such that seizing fingers 24 rise and fall once every one-sixth of a rotation of drum 3.

Thus, it is now possible to carry out the first operation, consisting in seizing the blank 1 situated at the very bottom of the stack held in storage means 20 and placing it on drum 3. For that purpose, drum 3 is momentarily stopped in such a way that a row of suction nozzles 35 is uppermost. Seizing fingers 24 are brought into their upper position, as shown in FIG. 2A, so that suction nozzles 25 are in contact with the underside of the blank 1 at the bottom of the stack. Suction source 93A is actuated, causing this blank to adhere to nozzles 25 while seizing fingers 24 start to move downward, as shown in FIG. 2B, whereby blank 1 is withdrawn from the bottom of the stack. Seizing fingers 24 continue to move downward and are inserted between disks 31, 32, 33, and 34, as explained above, until the underside of blank 1, i.e., its front 10, comes in contact with the nozzles 35 in uppermost position, as shown in FIG. 3A. At that moment, suction switch 92 actuates the suction of the nozzles 35 in the row at the top, while suction source 93A of the nozzles 25 of seizing fingers 24 is turned off. Seizing fingers 24 then continue to travel downward for a short distance in order to become completely disengaged from blank 1, which is now held by the suction of nozzles 35. Gearbox 91 then imparts a movement of rotation by 60° to drum 3 in order to advance blank 1 opposite checking means 4 and adhesive-depositing means 5, as illustrated in FIG. 4A. As soon as that position is reached, drum 3 again stops, and seizing fingers 24 return to their upper position in order to seize another blank 1 in the same way as just described.

As may be seen in FIG. 4A, checking means 4 and adhesive-depositing means 5 form a single unit disposed at an angle of 60° from the vertical and fixed to the frame of the apparatus in a manner known pet se. As shown diagrammatically in FIG. 4A, and as may also be seen in FIG. 4B and 4C, this unit passes above the blank 1 disposed on the nozzles 35, i.e., above the disks constituting drum 3. The unit will preferably be detachably fastened to or pivoted on the frame of the apparatus in order to give access to drum 3 in case of a breakdown.

In this preferred embodiment, checking means 4 comprise a plurality of transceiving photoelectric cells 40–45, shown diagrammatically in FIGS. 4B and 4C, transmitting respective rays 40A–45A toward rear face 11 of blank 1, which reflects them back to the respective cells 40–45.

Cell 40, disposed facing an approximately central location of blank 1, is intended to determine whether blank 1 is correctly oriented, i.e., whether it is indeed back 11, its non-printed side, which is upward. If so, ray 40A, emitted by cell 40 and reflected by the substantially white back 11, returns to the receiving part of cell 40 with a higher amplitude than would be the case if the ray were reflected by the printed front 10 inasmuch as printed front 10 would reflect less light than back 11. If a blank is not properly oriented, cell 40 will control the stopping of the machine so that the wrongly positioned blank can be withdrawn, and the operator can check whether the following blanks in the stack held in storage means 20 are correctly or incorrectly oriented and rectify their positions, if necessary.

For purposes of the present description, a correctly oriented blank has its back 11 facing outward, while its front 10 is in contact with the cylindrical support surface of drum 3. There can be no error of orientation about an axis perpendicular to the plane of blank 1 since the asymmetrical shape of the blank makes it possible to provide for angle-irons 20A of a shape adapted to receive only blanks correctly oriented relative to that axis.

Cell 41 may be disposed at any location where its ray 41A can be reflected by back 11 of blank 1. It is simply intended to detect the presence of a blank and controls adhesive-depositing device 5, as will be seen below.

Cells 42–45 are disposed in two parallel lines spaced at a distance which is very slightly less than the width of blank 1. In this way, if a blank 1 is slightly crooked, two of the rays 42A–45A will not be reflected toward the corresponding cells. A fault of this kind also controls stopping of the apparatus.

It will be obvious that checking device 4, described here with six transceiving photoelectric cells, may be arranged in any other suitable manner, with cells of another kind or disposed differently or with more or fewer cells.

Adhesive-depositing device 5, which, in the embodiment of the processing apparatus being described, is mounted on the same unit as checking device 4, is situated opposite the portion of blank 1 comprising surface 15 on which two spots of adhesive 14 are to be deposited, i.e., outside support disk 31. It comprises particularly an injection device 50 fed by a duct 51 coming from an adhesive supply (not shown) and, controlled by cell 41 as stated above, injecting two streams of adhesive 52, 53 through nozzles 54, 55 toward the two spots 14 to be gummed. The adhesive-depositing device may obviously comprise a number of nozzles other than two, just as it might deposit a strip of adhesive instead of one or more spots 14.

As soon as these monitoring and adhesive-depositing operations have been carried out, drum 3 resumes rotating; and it is during this second 60° rotation that folding of flap 16 about score 13A and gumming of flap 16 to surface portion 15 via adhesive spots 14 is performed, as well as the operation of coding impression 17 on surface portion 18.

It has been seen earlier that score 13A is disposed slightly to the outside of the plane containing the outer edge of support disk 31. As soon as drum 3 resumes rotation after the previous operations, then as shown in FIG. 5, flap 16 enters bending device 6, disposed on the outer side of support disk 31 and made up firstly of a guide device 60 in the shape of a spiral section in which flap 16 is bent up along score 13A and over surface portion 15. As soon as flap 16, bent over surface portion 15, leaves guiding device 60, blank 1 passes between two rollers 61 and 62 which are in contact along one of their generatrices and each rotate freely about an axis parallel to shaft 30.

Rollers 61 and 62 are situated on the outside of first support disk 31, the line of contact of the cylindrical outside surfaces of the two rollers being disposed in the previously defined cylindrical support surface and just after the exit end of guiding device 60. Since rollers 61 and 62 press firmly against one another, good adhesion of flap 16 to surface portion 15 is ensured by passage between the rollers of this surface portion, over which flap 16 has simply been bent, with drops of adhesive 14 previously placed between them. It will be noted in FIG. 2A that the centers of rollers 61 and 62 are aligned on a straight line passing through the center of drum 3, this line forming an angle of slightly less than 60° relative to the stopping position of drum 3 opposite unit 4/5.

Seeing that, in the embodiment being described, drum 3 rotates through an arc of exactly 60°, flap 16 is pressed onto surface portion 15 by rollers 61 and 62 when drum 3 is in motion, toward the end of its rotary movement when it is decelerating, in order that the excess torque exerted by the braking due to the pressure of the two rollers on flap 16 and surface portion 15 may not cause an increase in the driving torque of drum 3 but contribute to its braking.

It has been stated above that disk 33 has a dual function, both as a support disk and an impressing disk. For that purpose, it is made up as shown in FIGS. 6A and 6B in a first embodiment. Disk 33 comprises on its cylindrical outer surface a plurality of notches 70-six in this embodiment-distributed every 60° along the circumference of the disk and each containing a printing block 71 composed of types which may either form a unit or be individually separable.

In another embodiment (not shown), notches 70 may be larger than shown in the drawing, each printing block 71 being made up of a plurality of small disks, the common axis of which is perpendicular to the axis of rotation of disk 33, each of these small disks comprising a plurality of types disposed on its periphery. The angular position of these small disks is indexable by means known per se, in such a way that in printing position, a succession of characters, each belonging to this particular small disk, appears on the outer circumference of disk 33.

These types may be of any kind, either figures or letters or symbols, or they may constitute a bar-code. Thus, it is possible to compose any sort of code, whether it be a date, a number, a product name, or some other useful indication. Printing blocks 71 are preferably identical in each of the notches 70, though they might equally well be different from one notch to another. Each of the blocks 71, or each type, may be pulled out of the notch and exchanged for another printing block or another type in order to change the code 17 printed on blank 1. The printing blocks 71 or types within the respective notch 70 are secured there in a manner known per se so that the printing surface of the block or the types is flush with the cylindrical support surface of disk 33. Printing blocks 71, or the types thereof, are self-inking, i.e., the ink necessary for printing reaches them from inside disk 33 in a manner known per se in the art of printing. In order for code 17 to be correctly printed on surface portion 18 of the front 10 of blank 1, a pressure roller 72, preferably of a rubber-like material, rotating freely about an axis parallel to the longitudinal axis of drum 3, presses surface portion 18 against printing block 71 as it passes under roller 72. The angular position of the axis of roller 72 is preferably the same as that of rollers 61 and 62, as may be seen in FIG. 2A, for the same reasons as explained earlier.

Thus, during the travel over the second arc of 60°, it has been possible to bend flap 16 and glue it to surface portion 15, as well as to print code 17 on surface portion 18.

At the time of the following stop of drum 3, when blank 1 is at the 120° position, no operation is performed on blank 1.

Blank 1 is withdrawn from drum 3 at the next stop of the drum in the following position, viz., at 180°. For understanding this step, reference may again be made to FIG. 2A and 2B, as well as to FIG. 7. In the first embodiment described previously, withdrawing means 8 of the apparatus are composed mainly of a withdrawal device 80 and a discharge conveyor belt 81. Withdrawal device 80 also comprises a middle part 82 pivoting about an axis 83 parallel to the longitudinal axis of drum 3 and situated behind the drum, and a plurality of withdrawal fingers 84-four in the present example-extending from part 82 toward drum 3 and entering the spaces between the disks. Each withdrawal finger 84 is provided at the end thereof with a support surface 84A facing downward. Withdrawal device 80 further comprises a lever arm 85 projecting from middle part 82 in the opposite direction from fingers 84 and connected by a rod 85A to lever arm 27 of transfer means 21 in such a way that withdrawal fingers 84 are synchronized with seizing fingers 24, hence with the rotation of drum 3. When blank 1 on drum 3 arrives at the 180° position, withdrawal fingers 84 with their support surfaces 84A are in their upper position, i.e., blank 1 comes to rest upon these support surfaces. At that moment, distributor 92 cuts off the suction feed to nozzles 35 disposed at 180°, thus releasing blank 1, which then drops onto conveyor belt 81. This movement is accompanied by withdrawal fingers 84 to ensure that blank 1 is duly separated from drum 3 and does not continue inopportunely to adhere to it.

It will be seen from FIG. 2B that conveyor belt 81 is an endless belt, the upper length of which travels in the direction indicated by an arrow, preferably in a direction parallel to the longitudinal axis of drum 3. Belt 81 travels over two rollers 86, one of them driven by motor 90 via a gearbox 96. The outside surface of belt 81 is provided with lugs 81A for advancing the blanks 1 lying on the belt, particularly for pushing the blank leaving the conveyor belt between two driving rollers 87 driven by another driving unit 98 and rotating at a higher peripheral speed than the speed of travel of conveyor belt 81 in order to accelerate the outgoing blank and to send it on, for example, to another conveyor belt 88 which will take it to the cigarette-packaging machine (not shown).

FIG. 2C shows a modification of the withdrawal means. Blank 1, detached from drum 3 in the same way as previously, drops onto a double slide bar 180 made up principally of two plane upper faces leaving a longitudinal empty space between them. A gearbox 181, driven by motor 90, actuates a lever device 182 pivoting about its axis 183, the top end of which device can travel in the empty space between slide bars 180. Gearbox 181 imparts to lever 182 a movement of displacement toward the blank 1 which has been deposited on slide bars 180, so that the blank 1 is accelerated along its longitudinal direction, slides on slide bars 180 and reaches a position where it can be seized between a roller 184 and a belt 185. At that moment, lever 182 can continue its rotation or be returned to the rear for carrying the next blank along. Belt 185, which is advanced by a roller 186, comprises lugs 187 projecting from the center of the belt so that the blank 1 is then pushed by a projection 187 as it slides on two other slide bars 188 which also have a free space left between them for the passage of projections 187. Rollers 184 and 186 are driven by motorized means 189.

Control means 9 further comprise a control unit 97, which may be a microprocessor card or a suitable computer, for synchronizing the various steps of the method and monitoring the operation of the apparatus. In particular, control unit 97 controls the running of driving motor 90, verifies the presence of the blanks on the drum via checking device 4 and cell 41, as well as the correct positioning of the blanks via cells 40, 42, 43, 44, and 45. Control unit 97 also controls distributor 92 so that suction through nozzles 35 is actuated between the 0° and 180° positions of the drum in order to hold blank 1 there, and is cut off between the 180° and 360° positions. Control unit 97 may also act upon the packaging machine situated downstream so that if a blank is missing on the processing apparatus, spotted by cell 41, or is wrongly oriented, spotted by cell 40, the batch of cigarettes which was to have been packaged in that blank is held back by the packaging machine and is therefore not wasted.

Various other embodiments or modifications of the inventive apparatus may be envisaged. For one thing, one or another of the operations-adhesive depositing, bending a surface portion, or printing-might be omitted or placed in a different location than that described; similarly, one or another of these operations might be carried out several times for processing a particular packaging blank. In that case, the described arrangement of the support and holding disks on the longitudinal shaft might be different, just as it might be necessary to provide for more or fewer stopping positions of drum 3 than the four described above (0°, 60°, 120°, and 180°) over half a revolution of the drum. If so, everything described above as relating to a 60° angle would have to be adapted accordingly. For example, if five stopping positions were needed (0°, 45°, 90°, 135°, 180°), the rotational sequences of drum 3 would be of 45°, and there would particularly be eight rows of nozzles 35 disposed every 45° on holding disks 32, as well as eight printing blocks 71. The diameter of the disks, hence the diameter of the cylindrical support surface of drum 3, would be increased accordingly. For another thing, it is just as conceivable to envisage differences in some of the mechanical particularities described; in particular, the means for synchronizing seizing fingers 24 and withdrawal fingers 84 with the driving of drum 3 might be electronic, pneumatic, hydraulic, or other means.

Thus, through the inventive apparatus and method for processing packaging blanks, especially blanks for packs of cigarettes, it is possible to feed a packaging machine at a high rate inasmuch as the blanks do not leave the drum throughout all the processing operations. Moreover, in view of the reduced size of this drum, the processing apparatus takes up appreciably less space than prior art apparatus. Since the apparatus is so compact and highly integrated, and owing to the positioning checks carried out, the synchronization means are simplified, thus greatly limiting both waste and shutdowns owing to jamming.

What is claimed is:

1. A method of processing a packaging blank, said method comprising the steps of:

withdrawing the blank from a storage means by transfer means;

depositing the blank on a cylindrical support surface of a drum;

holding the blank in place by holding means after the transfer means have ceased their action;

actuating the drum with a discontinuous rotary movement;

thereafter carrying out the following processing steps:

checking the correct presence, positioning, and orientation of the blank by a checking means, depositing at least one drop of adhesive on at least one surface portion of the blank, folding at least one other surface portion of the blank onto the one surface portion thereby forming at least one fold, compressing the fold with compression means, and printing a code on at least one further surface portion of the blank; and thereafter carrying out the further steps of:

deactivating the holding means, and withdrawing the blank from the drum by withdrawal means.

2. The method of claim 1, wherein the blanks are deposited side by side on a peripheral portion of the cylindrical support surface of the drum and successively pass through said processing steps during sequences of rotation stopping of the drum.

3. The method of claim 2, wherein the drum is stopped in a first angular position during the step of depositing a blank on a portion of the cylindrical support surface of the drum, in a second angular position during the step of checking the presence, positioning and orientation of the blank, in a third angular position during the step of depositing adhesive, and in a fourth angular position during the step of withdrawing the blank from the drum.

4. The method of claim 3, wherein the second angular position and the third angular position are the same angular position.

5. The method of claim 2 wherein the drum is rotated during the steps of:

folding the at least one other surface portion of the blank;

compressing the fold; and printing the code.

6. The method of claim 1, wherein the steps of compressing the fold, and of printing the code, are carried out while the drum is decelerating.

7. A method of processing a packaging blank, said method comprising the steps of:

withdrawing the blank from a storage means by transfer means;

transferring the blank with the transfer means to a multi-function station including a drum having an axis of rotation, said multi-function station being capable of performing a plurality of functions for erecting the blank;

depositing the blank on a cylindrical support surface of the drum with the transfer means;

holding the blank in place by holding means after the transfer means have ceased their action;

actuating the drum with a discontinuous rotary movement;

carrying out at least one of said plurality of functions;

deactivating the holding means, and withdrawing the blank from the drum by a withdrawal means connected to the transfer means wherein the method step of withdrawing the blank from the storage means occurs simultaneously with the method step of withdrawing another blank from the cylindrical support surface of the drum.

8. The method of claim 7, wherein the blanks are deposited side by side on a peripheral portion of the cylindrical support surface of the drum and successively pass through said at least one function during sequences of rotation and stopping of the drum.

9. The method of claim 8, wherein:

said at least one function comprises the functions of:

checking the correct presence, positioning, and orientation of the blank by a checking means, and depositing at least one drop of adhesive on at least one surface portion of the blank; and the drum is stopped in a first angular position during the step of depositing a blank on a portion of the cylindrical support surface of the drum, in a second angular position during the step of checking the presence, positioning and orientation of the blank, in a third angular position during the step of depositing adhesive, and in a fourth angular position during the step of withdrawing the blank from the drum.

10. The method of claim 9, wherein the second angular position and the third angular position are the same angular position.

11. The method of claim 8 wherein:

said at least one function comprises the functions of:

folding at least one other surface portion of the blank onto the one surface portion thereby forming at least one fold, compressing the fold with compression means, and printing a code on at least one further surface portion of the blank; and the drum is rotated during the functions of:

folding the at least one other surface portion of the blank;

compressing the fold; and printing the code.

12. The method of claim 11, wherein the functions of compressing the fold, and of printing the code, are carried out while the drum is decelerating.

13. The method of claim 7 wherein said plurality of functions comprises checking the correct presence, positioning and orientation of the blank by a checking means.

14. The method of claim 7 wherein said plurality of functions comprises depositing at least one drop of adhesive on at least one surface portion of the blank.

15. The method of claim 7 wherein said plurality of functions comprises folding at least one surface portion of the blank onto another surface portion of the blank, thereby forming a fold.

16. The method of claim 15 wherein said plurality of functions further comprises compressing the fold with compression means.

17. The method of claim 16 wherein said plurality of functions further comprises printing a code on at least one further surface portion of the blank.

18. The method of claim 15 wherein said folding step comprises folding the blank along a line perpendicular to the axis of rotation of the drum.

19. The method of claim 7 wherein said plurality of functions further comprises printing a code on a surface portion of the blank.

20. The method of claim 7 wherein said plurality of functions comprises:

checking the correct presence, positioning and orientation of the blank by a checking means;

depositing at least one drop of adhesive on at least one surface portion of the blank;

folding at least one surface portion of the blank onto another surface portion of the blank along a line perpendicular to the axis of rotation of the drum, thereby forming a fold;

compressing the fold with compression means; and printing a code on at least one further surface portion of the blank.

21. Apparatus for processing packaging blanks, said apparatus comprising:

storage means for holding a plurality of said blanks;

transfer means for withdrawing said blanks from said storage means;

a multi-function station including a drum having:

a longitudinal axis, a cylindrical support surface, holding means for holding said blanks on said cylindrical support surface, driving means for rotating said drum about said longitudinal axis; said multi-function station further having a plurality of function means, each for performing one of a plurality of functions;

withdrawing means located on a side of the drum opposite the transfer means and connected to the transfer means for withdrawing said blanks from said cylindrical support surface while simultaneously withdrawing a blank from the storage means; and control means for synchronizing the operation of said apparatus.

22. The apparatus of claim 21 further comprising routing means for conveying said blanks to a following machine, wherein said withdrawing means is further for disposing said blanks on said routing means.

23. The apparatus of claim 22, wherein said routing means comprises a first conveyor belt, means for driving said first conveyor belt, two transfer rollers for receiving said blanks, means for driving said transfer rollers at a peripheral speed greater than the speed of advance of said first conveyor belt, a second conveyor belt, and means for driving said second conveyor belt at a speed of advance identical to said peripheral speed of said transfer rollers.

24. The apparatus of claim 23, wherein said first conveyor belt includes blank-pushing lugs disposed on an outer surface thereof.

25. The apparatus of claim 22, wherein said routing means comprises a double slide bar including a longitudinal free space, a lever having an upper portion capable of travelling in said free space, means for driving said lever in such a way that a blank disposed on said double slide bar is accelerated along its longitudinal direction, and transfer means comprising a first driven roller and a belt provided with projections.

26. The apparatus of claim 22, wherein said routing means comprises:

a first conveyor belt, two transfer rollers, and a second conveyor belt; and said control means comprises:

means for sequentially rotating said drum by portions of a revolution each followed by a stopping interval;

first synchronization means for synchronizing said transfer means in order to deposit one of said blanks on said cylindrical support surface when said drum is stopped;

second synchronization means for actuating holding of said one of said blanks deposited on said cylindrical support surface and for deactivating said holding when said one of said blanks is in withdrawing position;

third synchronization means for depositing at least one drop of adhesive on at least one surface portion of one of said blanks when said drum is stopped;

fourth synchronization means for causing said withdrawing means to accompany said one of said blanks during travel thereof toward said routing means;

fifth synchronization means for adjusting the speeds of said routing and transfer means;

first monitoring means for inhibiting said adhesive depositing means in the absence of one of said blanks in position to receive adhesive; and second monitoring means for stopping said apparatus when one of said blanks is incorrectly oriented or aligned.

27. The apparatus of claim 26, wherein said control means further comprises monitoring means for blocking a pack of products intended to be packaged in one of said blanks when said one of said blanks is missing from said processing apparatus.

28. The apparatus of claim 26, wherein said portions of a revolution are sixths of a revolution.

29. The apparatus of claim 21 wherein said plurality of function means comprises checking means for checking the correct presence, positioning and orientation of the blank.

30. The apparatus of claim 29 wherein said checking means comprises a first set of detection cells for detecting the presence of one of said blanks, a second set of detection cells for detecting the orientation of said one of said blanks, and a third set of detection cells for detecting the alignment of said one of said blanks.

31. The apparatus of claim 30, further comprising means for depositing adhesive wherein said first set of detection cells is adapted to control a deposit of at least one drop of adhesive by said means for depositing adhesive when one of said blanks is in position to receive said adhesive.

32. The apparatus of claim 30, wherein said second set and said third set of detection cells are adapted to control stopping of the machine when one of said blanks is incorrectly oriented or aligned.

33. The apparatus of claim 32, wherein said second set and said third set of cells are further adapted to control blocking, on a packaging machine, of a batch of products intended to be packaged in said incorrectly oriented or aligned one of said blanks.

34. The apparatus of claim 30, wherein said detection cells are photoelectric emitting and receiving cells.

35. The apparatus of claim 21, wherein said plurality of function means comprises means for depositing at least one drop of adhesive on at least one surface portion of the blank.

36. The apparatus of claim 21 wherein said plurality of function means comprises means for folding at least one surface portion of the blank onto another surface portion of the blank, thereby forming a fold.

37. The apparatus of claim 36, wherein said means for folding comprises a semi-helical guide rail disposed substantially perpendicular to said longitudinal axis.

38. The apparatus of claim 36 wherein said plurality of function means further comprises compression means for compressing the fold.

39. The apparatus of claim 38, wherein said compression means comprises two rollers adapted to rotate about respective axes disposed parallel to said longitudinal axis.

40. The apparatus of claim 38 wherein said plurality of function means further comprises means for printing a code on at least one further surface portion of the blank.

41. The apparatus of claim 36 wherein said folding means folds the blank along a line perpendicular to the longitudinal axis of the drum.

42. The apparatus of claim 21 wherein said plurality function means further comprises means for printing a code on a surface portion of the blank.

43. The apparatus of claim 21 wherein said plurality of function means comprises:

checking means for checking the correct presence, positioning and orientation of the blank;

means for depositing at least one drop of adhesive on at least one surface portion of the blank;

means for folding at least one surface portion of the blank onto another surface portion of the blank along a line perpendicular to the axis of rotation of the drum, thereby forming a fold;

compression means for compressing the fold; and means for printing a code on at least one further surface portion of the blank.

44. The apparatus of claim 43, wherein said checking means comprises a first set of detection cells for detecting the presence of one of said blanks, a second set of detection cells for detecting the orientation of said one of said blanks, and a third set of detection cells for detecting the alignment of said one of said blanks, said first set of detection cells being adapted to control the deposit of at least one drop of adhesive by said means for depositing adhesive when one of said blanks is in position to receive said adhesive, said means for depositing adhesive comprising at least one injection nozzle and an injection device connected to said at least one injection nozzle for depositing a predetermined quantity of adhesive on said at least one first surface portion, said injection device being controlled by said first set of detection cells.

45. The apparatus of claim 44, wherein said detection cells are photoelectric emitting and receiving cells.

46. The apparatus of claim 21, wherein said drum comprises:

a longitudinal shaft, a plurality of circular support disks of equal diameter spaced from one another coaxially on said shaft perpendicular thereto and together defining Said cylindrical support surface, a plurality of circular holding disks of equal diameter disposed coaxially on said shaft perpendicular thereto and parallel to said support disks, one or more of said holding disks being disposed between said support disks, and the diameter of said holding disks being less than the diameter of said support disks, and a plurality of suction nozzles disposed at regular intervals along the circumference of each of said holding disks and including respective suction orifices aligned along respective generatrices of said cylindrical support surface and tangent thereto, said suction nozzles constituting said holding means; and said driving means is adapted to rotate said drum sequentially about the longitudinal axis thereof in portions of a revolution, each followed by a stop.

47. The apparatus of claim 46, further comprising suction means, suction switching means for sequentially actuating and cutting off suction to said suction nozzles, and a plurality of suction ducts respectively connected to each alignment of said suction nozzles along a single one of said generatrices, said ducts being separate and each being connected via said suction switching means to said suction means.

48. The apparatus of claim 46, wherein said transfer means comprises:

a part pivoted about a pivoting axis parallel to the longitudinal axis of said drum;

a plurality of seizing fingers projecting perpendicular to said pivoting axis toward said drum and capable of entering from outside said cylindrical support surface into the spaces between said disks;

means for actuating said pivoting axis, thereby imparting a raising and lowering motion to said seizing fingers, synchronized with the rotational movement of said drum;

a plurality of further suction nozzles respectively disposed on said plurality of seizing fingers; and means for turning on each of said further suction nozzles between the raised position of said fingers, for seizing one of said blanks situated in said storage means, and a position near the lowered position of said fingers corresponding to a position where said one of said blanks is deposited longitudinally on said cylindrical support surface, said further suction nozzles being turned off between the depositing position and the lowered position of said fingers and between said lowered position and said raised position.

49. The apparatus of claim 46, wherein:

at least one of said support disks includes inking means disposed in the interior thereof and a plurality of notches regularly distributed along the periphery thereof;

said means for printing comprises:

a plurality of printing blocks, optionally made up of indexable disks, respectively disposed in said notches and having printing surfaces disposed flush with said cylindrical support surface, and a pressure roller adapted for rotation about an axis parallel to said longitudinal axis for pressing a said third surface portion against one of said printing blocks situated facing said pressure roller; and said printing surfaces communicate with said inking means.

50. The apparatus of claim 49, wherein said printing blocks are removable.

51. The apparatus of claim 50 wherein said printing blocks comprise a plurality of discretely interchangeable types.

52. The apparatus of claim 46, wherein said withdrawing means comprises:

a part pivoted about a pivoting axis parallel to the longitudinal axis of said drum;

a plurality of withdrawal fingers projecting perpendicular to said pivoting axis toward said drum and capable of entering from outside said cylindrical support surface into the spaces between said disks;

means for actuating said pivoting axis, thereby imparting a raising and lowering motion to said withdrawal fingers, synchronized with the rotational movement of said drum; and a plurality of withdrawal support surfaces respectively disposed on said plurality of withdrawal fingers for supporting individual said blanks.

53. A machine for packaging packs of cigarettes, said machine being equipped with apparatus for processing packaging blanks, said apparatus comprising:

storage means for holding a plurality of said blanks;

transfer means for withdrawing said blanks from said storage means;

a multi-function station including a drum having:

a longitudinal axis, a cylindrical support surface, holding means for holding said blanks on said cylindrical support surface, driving means for rotating said drum about said longitudinal axis; said multi-function station further having a plurality of function means, each for performing one of a plurality of functions;

withdrawing means located on a side of the drum opposite the transfer means and connected to the transfer means for withdrawing said blanks from said cylindrical support surface while simultaneously withdrawing a blank from the storage means; and control means for synchronizing the operation of said apparatus.

54. A method of processing a packaging blank, said method comprising the steps of:

withdrawing the blank from a storage means by transfer means;

transferring the blank with the transfer means to a multi-function station including a drum having an axis of rotation, said multi-function station being capable of performing a plurality of functions for erecting the blank;

depositing the blank on a cylindrical support surface of the drum with the transfer means, wherein the blanks are deposited side by side on a peripheral portion of the cylindrical support surface of the drum and successively pass through said at least one function during sequences of rotation and stopping of the drum;

holding the blank in place by holding means after the transfer means have ceased their action;

actuating the drum with a discontinuous rotary movement;

carrying out at least one of said plurality of functions, wherein the step of carrying out said at least one function comprises carrying out the functions of:

checking the correct presence, positioning, and orientation of the blank by a checking means;

depositing at least one drop of adhesive on at least one surface portion of the blank;

deactivating the holding means; and withdrawing the blank from the drum by a withdrawal means; wherein the drum is stopped in a first angular position during the step of depositing a blank on a portion of the cylindrical support surface of the drum, in a second angular position during the step of checking the presence, positioning and orientation of the blank, in a third angular position during the step of depositing adhesive, and in a fourth angular position during the step of withdrawing the blank from the drum.

55. The method of claim 54, wherein the second angular position and the third angular position are the same angular position.

56. A method of processing a packaging blank, said method comprising the steps of:

withdrawing the blank from a storage means by transfer means, transferring the blank with the transfer means to a multi-function station including a drum having an axis of rotation, said multi-function station being capable of performing a plurality of functions for erecting the blank;

depositing the blank on a cylindrical support surface of the drum with the transfer means, wherein the blanks are deposited side by side on a peripheral portion of the cylindrical support surface of the drum and successively pass through said at least one function during sequences of rotation and stopping of the drum;

holding the blank in place by holding means after the transfer means have ceased their action;

actuating the drum with a discontinuous rotary movement;

carrying out at least one of said plurality of functions, wherein carrying out said at least one function comprises carrying out the functions of:

folding at least one other surface portion of the blank onto the one surface portion thereby forming at least one fold, compressing the fold with compression means, and printing a code on at least one further surface portion of the blank; and wherein the drum is rotated during the functions of folding the at least one other surface portion of the blank; compressing the fold; and printing the code; and further comprising the steps of deactivating the holding means, and withdrawing the blank from the drum by a withdrawal means.

57. A method of processing a packaging blank, said method comprising the steps of:

withdrawing the blank from a storage means by transfer means;

transferring the blank with the transfer means to a multi-function station including a drum having an axis of rotation, said multi-function station being capable of performing a plurality of functions for erecting the blank;

depositing the blank on a cylindrical support surface of the drum with the transfer means;

holding the blank in place by holding means after the transfer means have ceased their action;

actuating the drum with a discontinuous rotary movement;

carrying out at least one of said plurality of functions, wherein carrying out said plurality of functions comprises checking the correct presence, positioning and orientation of the blank by a checking means;

deactivating the holding means, and withdrawing the blank from the drum by a withdrawal means.

58. A method of processing a packaging blank, said method comprising the steps of:

withdrawing the blank from a storage means by transfer means;

transferring the blank with the transfer means to a multi-function station including a drum having an axis of rotation, said multi-function station being capable of performing a plurality of functions for erecting-the blank;

depositing the blank on a cylindrical support surface of the drum with the transfer means;

holding the blank in place by holding means after the transfer means have ceased their action;

actuating the drum with a discontinuous rotary movement;

carrying out at least one of said plurality of functions, wherein said plurality of functions comprises folding at least one surface portion of the blank onto another surface portion of the blank along a line perpendicular to the axis of rotation of the drum, thereby forming a fold;

deactivating the holding means; and withdrawing the blank from the drum by a withdrawal means.

59. Apparatus for processing packaging blanks, said apparatus comprising:

storage means for holding a plurality of said blanks;

transfer means for withdrawing said blanks one by one from said storage means;

a multi-function station including a drum having:

a longitudinal axis, a cylindrical support surface, holding means for holding said blanks on said cylindrical support surface, driving means for rotating said drum about said longitudinal axis;

said multi-function station further having a plurality of function means, each for performing one of a plurality of functions;

withdrawing means for withdrawing said blanks from said cylindrical support surface;

control means for synchronizing the operation of said apparatus; and routing means for conveying said blanks to a following machine, wherein said withdrawing means is further for disposing said blanks on said routing means, wherein said routing means comprises a first conveyor belt, means for driving said first conveyor belt, two transfer rollers for receiving said blanks, means for driving said transfer rollers at a peripheral speed greater than the speed of advance of said first conveyor belt, a second conveyor belt, and means for driving said second conveyor belt at a speed of advance identical to said peripheral speed of said transfer rollers.

60. The apparatus of claim 59, wherein said first conveyor belt includes blank-pushing lugs disposed on an outer surface thereof.

61. Apparatus for processing packaging blanks, said apparatus comprising:

storage means for holding a plurality of said blanks;

transfer means for withdrawing said blanks one by one from said storage means;

a multi-function station including a ,drum having:

a longitudinal axis, a cylindrical support surface, holding means for holding said blanks on said cylindrical support surface, driving means for rotating said drum about said longitudinal axis;

said multi-function station further having a plurality of function means, each for performing one of a plurality of functions;

withdrawing means for withdrawing said blanks from said cylindrical support surface;

control means for synchronizing the operation of said apparatus; and routing means for conveying said blanks to a following machine, wherein said withdrawing means is further for disposing said blanks on said routing means, wherein said routing means comprises a double slide bar including a longitudinal free space, a lever having an upper portion capable of travelling in said free space, means for driving said lever in such a way that a blank disposed on said double slide bar is accelerated along its longitudinal direction, and transfer means comprising a first driven roller and a belt provided with projections.

62. Apparatus for processing packaging blanks, said apparatus comprising:

storage means for holding a plurality of said blanks;

transfer means for withdrawing said blanks one by one from said storage means;

a multi-function station including a drum having:

a longitudinal axis, a cylindrical support surface, holding means for holding said blanks on said cylindrical support surface, driving means for rotating said drum about said longitudinal axis;

said multi-function station further having a plurality of function means, each for performing one of a plurality of functions;

withdrawing means for withdrawing said blanks from said cylindrical support surface;

control means for synchronizing the operation of said apparatus; and routing means for conveying said blanks to a following machine, wherein said withdrawing means is further for disposing said blanks on said routing means, wherein said routing means comprises:

a first conveyor belt, two transfer rollers, and a second conveyor belt;

and said control means comprises:

means for sequentially rotating said drum by portions of a revolution each followed by a stopping interval;

first synchronization means for synchronizing said transfer means in order to deposit one of said blanks on said cylindrical support surface when said drum is stopped;

second synchronization means for actuating holding of said one of said blanks deposited on said cylindrical support surface and for deactivating said holding when said one of said blanks is in withdrawing position;

third synchronization means for depositing at least one drop of adhesive on at least one surface portion of one of said blanks when said drum is stopped;

fourth synchronization means for causing said withdrawing means to accompany said one of said blanks during travel thereof toward said routing means;

fifth synchronization means for adjusting the speed of said routing and transfer means;

first monitoring means for inhibiting said adhesive depositing means in the absence of one of said blanks in position to receive adhesive; and second monitoring means for stopping said apparatus when one of said blanks is incorrectly oriented or aligned.

63. The apparatus of claim 62, wherein said control means further comprises monitoring means for blocking a pack of products intended to be packaged in one of said blanks when said one of said blanks is missing from said processing apparatus.

64. The apparatus of claim 62, wherein said portions of a revolution are sixths of a revolution.

65. Apparatus for processing packaging blanks, said apparatus comprising:

storage means for holding a plurality of said blanks;

transfer means for withdrawing said blanks one by one from said storage means;

a multi-function station including a drum having:

a longitudinal axis, a cylindrical support surface, holding means for holding said blanks on said cylindrical support surface, driving means for rotating said drum about said longitudinal axis;

said multi-function station further having a plurality of function means, each for performing one of a plurality of functions, wherein said plurality of function means comprises checking means for checking the correct presence, positioning and orientation of the blank;

withdrawing means for withdrawing said blanks from said cylindrical support surface; and control means for synchronizing the operation of said apparatus.

66. The apparatus of claim 65 wherein said checking means comprises a first set of detection cells for detecting the presence of one of said blanks, a second set of detection cells for detecting the orientation of said one of said blanks, and a third set of detection cells for detecting the alignment of said one of said blanks.

67. The apparatus of claim 66, further comprising means for depositing adhesive, wherein said first set of detection cells is adapted to control a deposit of at least one drop of adhesive by said means for depositing adhesive when one of said blanks is in position to receive said adhesive.

68. The apparatus of claim 66, wherein said second set and said third set of detection cells are adapted to control stopping of the machine when one of said blanks is incorrectly oriented or aligned.

69. The apparatus of claim 68, wherein said second set and said third set of cells are further adapted to control blocking, on a packaging machine, of a batch of products intended to be packaged in said incorrectly oriented or aligned one of said blanks.

70. The apparatus of claim 66, wherein said detection cells are photoelectric emitting and receiving cells.

71. Apparatus for processing packaging blanks, said apparatus comprising:

storage means for holding a plurality of said blanks;
transfer means for withdrawing said blanks one by one from said storage means;
a multi-function station including a drum having:
a longitudinal axis,
a cylindrical support surface,
holding means for holding said blanks on said cylindrical support surface,
driving means for rotating said drum about said longitudinal axis;
said multi-function station further having a plurality of function means, each for performing one of a plurality of functions, wherein said plurality of function means comprises means for folding at least one surface portion of the blank onto another surface portion of the blank, thereby forming a fold, wherein said means for folding comprises a semi-helical guide rail disposed substantially perpendicular to said longitudinal axis;
withdrawing means for withdrawing said blanks from said cylindrical support surface; and
control means for synchronizing the operation of said apparatus.

72. Apparatus for processing packaging blanks, said apparatus comprising:

storage means for holding a plurality of said blanks;
transfer means for withdrawing said blanks one by one from said storage means;
a multi-function station including a drum having:
a longitudinal axis,
a cylindrical support surface,
holding means for holding said blanks on said cylindrical support surface,
driving means for rotating said drum about said longitudinal axis;
said multi-function station further having a plurality of function means, each for performing one of a plurality of functions, wherein said plurality of function means comprises means for folding at least one surface portion of the blank onto another surface portion of the blank, thereby forming a fold, and compression means for compressing the fold, wherein said compression means comprises two rollers adapted to rotate about respective axes disposed parallel to said longitudinal axis;
withdrawing means for withdrawing said blanks from said cylindrical support surface; and
control means for synchronizing the operation of said apparatus.

73. Apparatus for processing packaging blanks, said apparatus comprising:

storage means for holding a plurality of said blanks;
transfer means for withdrawing said blanks one by one from said storage means;
a multi-function station including a drum having:
a longitudinal axis,
a cylindrical support surface,
holding means for holding said blanks on said cylindrical support surface,
driving means for rotating said drum about said longitudinal axis;
said multi-function station further having a plurality of function means, each for performing one of a plurality of functions; wherein said plurality of function means comprises means for folding at least one surface portion of the blank onto another surface portion of the blank, thereby forming a fold; wherein said folding means folds the blank along a line perpendicular to the longitudinal axis of the drum;
withdrawing means for withdrawing said blanks from said cylindrical support surface; and
control means for synchronizing the operation of said apparatus.

74. Apparatus for processing packaging blanks, said apparatus comprising:

storage means for holding a plurality of said blanks;
transfer means for withdrawing said blanks one by one from said storage means;
a multi-function station including a drum having:
a longitudinal axis,
a cylindrical support surface,
holding means for holding said blanks on said cylindrical support surface,
driving means for rotating said drum about said longitudinal axis;
said multi-function station further having a plurality of function means, each for performing one of a plurality of functions wherein said plurality of function means comprises:
checking means for checking the correct presence, positioning and orientation of the blank;
means for depositing at least one drop of adhesive on at least one surface portion of the blank; and further comprising
means for folding at least one surface portion of the blank onto another surface portion of the blank along a line perpendicular to the axis of rotation of the drum, thereby forming a fold;
compression means for compressing the fold; and
means for printing a code on at least one further surface portion of the blank; said apparatus further comprising
withdrawing means for withdrawing said blanks from said cylindrical support surface; and
control means for synchronizing the operation of said apparatus.

75. The apparatus of claim 74, wherein said checking means comprises a first set of detection cells for detecting the presence of one of said blanks, a second set of detection cells for detecting the orientation of said one of said blanks, and a third set of detection cells for detecting the alignment of said one of said blanks, said first set of detection cells being adapted to control the deposit of at least one drop of adhesive by said means for depositing adhesive when one of said blanks is in position to receive said adhesive, said means for depositing adhesive comprising at least one injection nozzle and an injection device connected to said at least one injection nozzle for depositing a predetermined quantity of adhesive on said at least one first surface portion, said injection device being controlled by said first set of detection cells.

76. The apparatus of claim 74, wherein said detection cells are photoelectric emitting and receiving cells.

77. Apparatus for processing packaging blanks, said apparatus comprising:

storage means for holding a plurality of said blanks;

transfer means for withdrawing said blanks one by one from said storage means;

a multi-function station including a drum having:

a longitudinal axis, a cylindrical support surface, holding means for holding said blanks on said cylindrical support Surface, driving means for rotating said drum about said longitudinal axis;

wherein said drum further comprises:

a longitudinal shaft, a plurality of circular support disks of equal diameter spaced from one another coaxially on said shaft perpendicular thereto and together defining said cylindrical support surface, a plurality of circular holding disks of equal diameter disposed coaxially on said shaft perpendicular thereto and parallel to said support disks, one or more of said holding disks being disposed between said support disks, and the diameter of said holding disks being less than the diameter of said support disks, and a plurality of suction nozzles disposed at regular intervals along the circumference of each of said holding disks and including respective suction orifices aligned along respective generatrices of said cylindrical support surface and tangent thereto, said suction nozzles constituting said holding means; and said driving means is adapted to rotate said drum sequentially about the longitudinal axis thereof in portions Of a revolution, each followed by a stop;

said multi-function station further having a plurality of function means, each for performing one of a plurality of functions; said apparatus further comprising withdrawing means for withdrawing said blanks from said cylindrical support surface; and control means for synchronizing the operation of said apparatus.

78. The apparatus of claim 77, further comprising suction means, suction switching means for sequentially actuating and cutting off suction to said suction nozzles, and a plurality of suction ducts respectively connected to each alignment of said suction nozzles along a single one of said generatrices, said ducts being separate and each being connected via said suction switching means to said suction means.

79. The apparatus of 77, wherein said transfer means comprises:

a part pivoted about a pivoting axis parallel to the longitudinal axis of said drum;

a plurality of seizing fingers projecting perpendicular to said pivoting axis toward said drum and capable of entering from outside said cylindrical support surface into the spaces between said disks;

means for actuating said pivoting axis, thereby imparting a raising and lowering motion to said seizing fingers, synchronized with the rotational movement of said drum;

a plurality of further suction nozzles respectively disposed on said plurality of seizing fingers; and means for turning on each of said further suction nozzles between the raised position of said fingers, for seizing one of said blanks situated in said storage means, and a position near the lowered position of said fingers corresponding to a position where said one of said blanks is deposited longitudinally on said cylindrical support surface, said further suction nozzles being turned off between the depositing position and the lowered position of said fingers and between said lowered position and said raised position.

80. The apparatus of claim 77, wherein:

at least one of said support disks includes inking means disposed in the interior thereof and a plurality of notches regularly distributed along the periphery thereof;

said means for printing comprises:

a plurality of printing blocks, optionally made up of indexable disks, respectively disposed in said notches and having printed surfaces disposed flush with said cylindrical support surface, and a pressure roller adapted for rotation about an axis parallel to said longitudinal axis for pressing a said third surface portion against one of said printing blocks situated facing said pressure roller; and said printing surfaces communicate with said inking means.

81. The apparatus of claim 80, wherein said printing blocks are removable.

82. The apparatus of claim 81, wherein said printing blocks comprise a plurality of discretely interchangeable types.

83. The apparatus of claim 77, wherein said withdrawing means comprises:

a part pivoted about a pivoting axis parallel to the longitudinal axis of said drum;

a plurality of withdrawal fingers projecting perpendicular to said pivoting axis toward said drum and capable of entering from outside said cylindrical support surface into the spaces between said disks;

means for actuating said pivoting axis, thereby imparting a raising and lowering motion to said withdrawal fingers, synchronized with the rotational movement of said drum; and a plurality of withdrawal support surfaces respectively disposed on said plurality of withdrawal fingers for supporting individual said blanks.

* * * * *